United States Patent [19]

Hafner et al.

[11] 4,376,501

[45] Mar. 15, 1983

[54] CLOSURE ELEMENT AND ASSEMBLY OF A SLIDE CLOSURE FOR USE IN LIQUID MELT CONTAINERS

[75] Inventors: Alfred Hafner, Wädenswil, Switzerland; Udo Muschner, Tönisvorst, Fed. Rep. of Germany

[73] Assignee: Stopinc Aktiengesellschaft, Baar, Switzerland

[21] Appl. No.: 254,149

[22] Filed: Apr. 14, 1981

[30] Foreign Application Priority Data

May 9, 1980 [CH] Switzerland ..... 3813/80

[51] Int. Cl.[3] ..... B22D 37/00; B22D 11/10

[52] U.S. Cl. ..... 222/600

[58] Field of Search ..... 266/287, 275, 242; 220/253; 222/597, 598, 599, 600, 601, 602, 561; 164/335, 337

[56] References Cited

U.S. PATENT DOCUMENTS 3,430,644 3/1969 Lyman ..... 222/600 X
3,780,916 12/1973 Shapland ..... 251/206 X
4,314,659 2/1982 Shapland ..... 222/598 X

*Primary Examiner*—L. Dewayne Rutledge
*Assistant Examiner*—David A. Hey
*Attorney, Agent, or Firm*—Wenderoth, Lind & Ponack

[57] ABSTRACT

A closure element of a slide closure includes a refractory plate having a sliding surface, peripheral edges and at least one flow passage extending through the refractory plate from the sliding surface to an opposite surface spaced therefrom. A metallic sheath partially encompasses the refractory plate and includes an edge portion embracing the peripheral edges of the refractory plate about the entire periphery thereof and a bottom portion adjacent the opposite surface of the refractory plate. The bottom portion of the metallic sheath has formed therein a plurality of openings exposing therethrough a plurality of surface areas of the opposite surface of the refractory plate. The plurality of openings are separated from each other and from the edge portion of the metallic sheath by a plurality of strips which thus form the bottom portion. At least some of the exposed surface areas are aligned, preferably parallel, to the sliding surface and form surfaces for engagement with a metal support frame to support the closure element.

29 Claims, 4 Drawing Figures

CLOSURE ELEMENT AND ASSEMBLY OF A SLIDE CLOSURE FOR USE IN LIQUID MELT CONTAINERS

BACKGROUND OF THE INVENTION

The present invention relates to a closure element and to a closure element assembly of a slide closure for use in liquid melt containers.

Basically two systems are known and customary for the exchangeable installation of fireproof or refractory plates, for example stationary bottom plates or movable side plates, of slide closures for use in metallurgical installations, such as metallurgical melting crucibles, which are subject to high wear. The first known system is to employ mortar to position the refractory plate directly in a metal support frame, such as a module frame. This refractory mortar is broken out when it is necessary to exchange the refractory plate. The second known system is to embed the refractory plate in a metallic sheath or jacket, whereby the plate unit including the refractory plate and metallic sheath is then positioned within a support frame without the use of mortar. The present invention is specifically directed to improvements of this second type of system, i.e. such system including a metallic sheath.

The fundamental purpose of a metallic sheath of this type is to provide the fireproof or refractory plate with a solid consistency, i.e. to hold the plate together, when, during the operation of the slide closure, cracks occur in the refractory plate. The formation of such cracks is practically unavoidable, given the extremely high thermal and mechanical stresses involved. Such cracks would have serious consequences if the resultant fragments of the refractory plate are allowed to spread apart or to shift relative to each other during the actuation of the slide closure. In order to safely prevent such occurrence, the metallic sheath should include a bottom portion as well as an edge or rim portion which embraces the periphery of the refractory plate. That is, the mere provision of a metallic strap placed around the edge of the plate in a hoop-like fashion would generally not be considered sufficient.

However, prior art arrangements of this type, i.e. including a refractory plate, a metallic sheath and a metal support frame, involve certain disadvantages which have been inherent. Thus, it is difficult to connect the refractory plate and the metallic sheath with the necessary precision by mass production techniques. In particular, the metallic sheath bottom portion must be very precisely aligned with the opposite surface of the refractory plate, i.e. that surface thereof which forms the sliding surface of the closure element, so that the necessary tightness between the refractory plate and another refractory plate of the slide closure is ensured during operation of the slide closure, and to ensure that the sliding plate does not get stuck during operation. However, any existing deviations in dimensions between the refractory plate and the metallic sheath can only be imperfectly compensated for by the mortar layer interposed therebetween. This is due to the fact that the mortar is subject to a certain degree of shrinkage during the drying or setting process, such shrinking not always being the same. Therefore, proper positioning and the achievement of parallel plane surfaces of the sliding surface of the refractory plate and the bottom portion of the metallic sheath can be achieved only by means of complicated and expensive supplemental assembly operations. Additionally, the mortar layer itself will not always provide a completely safe base for the refractory plate or its fragments due to pressing of the refractory plate during operation of the slide closure. Thus, local differences can exist in the amount of compression to which the mortar is subjected, and the mortar can thus sometimes become heated to such an extent during operation that it becomes soft, thereby enabling variations in the relative position of the refractory plate and the metallic sheath.

SUMMARY OF THE INVENTION

With the above discussion in mind, it is the object of the present invention to provide a closure element and assembly of a slide closure for use in liquid melt containers which overcomes the prior disadvantages.

It is a further object of the present invention to provide such a closure element and assembly including a metallic sheath which provides the essential holding together function of the refractory plate, while at the same time enabling production by means of practical and efficient mass production techniques while ensuring the necessary dimensional precision.

These objects are achieved in accordance with one aspect of the present invention by the provision of a closure element of a slide closure for use in liquid melt containers, such closure element including a refractory plate having a sliding surface, peripheral edges and at least one flow passage extending through the refractory plate from the sliding surface to an opposite surface spaced therefrom. A metallic sheath partially encompasses the refractory plate, the metallic sheath including an edge portion embracing the peripheral edges of the refractory plate about the entire periphery thereof and a bottom portion adjacent the opposite surface of the refractory plate. The bottom portion of the metallic sheath has formed therein a plurality of openings exposing therethrough a plurality of surface areas of the opposite surface of the refractory plate, such openings including one opening in the area of the flow passage. The plurality of openings are separated from each other and from the edge portion of the metallic sheath by a plurality of strips which together form the bottom portion. At least some of the exposed surface areas are aligned relative to the sliding surface to form engagements with a metallic support frame for supporting the closure element.

In accordance with a further aspect of the present invention there is provided an assembly which additionally includes a metal support frame having surfaces in planar engagement with the aligned exposed surface areas, thereby supporting the refractory plate and the metallic sheath.

Due to the fact that the bottom surface of the bottom portion of the metallic sheath forms no portion of the support or base of the closure element, the closure element may be assembled without providing any dimensional preciseness between the sliding surface of the refractory plate and the bottom surface of the metallic sheath. Rather, dimensional preciseness of the closure element itself need be provided only with regard to the sliding surface of the refractory plate. In the assembly including the metal support frame, dimensional preciseness is provided between the aligned exposed surface areas of the refractory plate and the abutting surfaces of the metal support frame. The metallic sheath is spaced from the metal support frame and forms no portion of the support thereof, and therefore the alignment of the bottom surface thereof need not be made with precision. Thus, it will be apparent that the manufacture and assembly of the closure element and assembly according to the present invention are greatly simplified compared with known assembly techniques, and that the required dimensional preciseness may be achieved by mass production techniques which were not practical with prior art arrangements.

It is to be understood that the concept of the present invention is applicable to stationary bottom plates or movable slide plates of otherwise known type slide closures for use in liquid melt containers. Furthermore, it is to be understood that the present invention is applicable to such closure elements of slide closures of the linear, rotary or pivoted movement type.

The stiffness or rigidity of the metallic jacket, and the necessary holding together effect for the refractory plate achieved thereby, is practically not impaired by the provision of the openings in the bottom portion of the metallic jacket. In this regard, it is advantageous that the strips forming the bottom portion of the metallic sheath include a continuous rim strip integral with the edge portion of the metallic sheath around the entire periphery thereof, and/or to provide such strips forming the bottom portion of the metallic sheath to include inner strips which are connected to each other to form a network extending or spreading over the bottom or opposite surface of the refractory plate.

Preferably, the sliding surface of the refractory plate is planar, and the aligned exposed surface areas of the opposite surface of the refractory plate are aligned to extend parallel to the sliding surface, preferably in a single plane extending parallel to the plane of the sliding surface.

In accordance with one embodiment of the present invention, the aligned exposed surface areas are formed on projections of the refractory plate which extend through respective of the openings. In accordance with another embodiment of the present invention, the aligned exposed surface areas are at a level inwardly of the outer surface of the bottom portion of the metallic sheath, preferably by forming the opposite surface of the refractory plate as a single planar surface including such aligned exposed surface areas. The aligned exposed surface areas extend in a plane at a level spaced from the outer surface of the bottom portion of the metallic sheath, such that the bottom portion of the metallic sheath is spaced from and out of contact with the metal support frame. When the aligned exposed surface areas of the refractory plate are on projections which extend through the openings, the manufacture of the metal support frame is simplified. Conversely, when the aligned exposed surface areas of the refractory plate are formed in a single planar surface, manufacture of the refractory plate is simplified. In both cases however, it is advantageous that all of the aligned exposed surface areas extend in a common single plane parallel to the sliding surface, whereby the formation of the aligned exposed surface areas is simplified, for example by a single machining operation such as grinding.

One opening in the metallic sheath exposes an annular zone of the opposite surface of the refractory plate. This annular zone surrounds the flow passage and is adapted to be connected to a refractory element, such as a nozzle, which extends the flow passage. The annular zone may be at the same level as or a different level from the level of the aligned exposed surface areas. When the annular zone is formed at a different level than the level of the aligned exposed surface areas, such annular zone need not be formed with precision, since such annular zone is not involved in the support and alignment of the refractory plate.

BRIEF DESCRIPTION OF THE DRAWINGS

The above and other objects, features and advantages of the present invention will be made more apparent from the following detailed description, taken with the accompanying drawings, wherein.

DETAILED DESCRIPTION OF THE INVENTION

Figure 1:
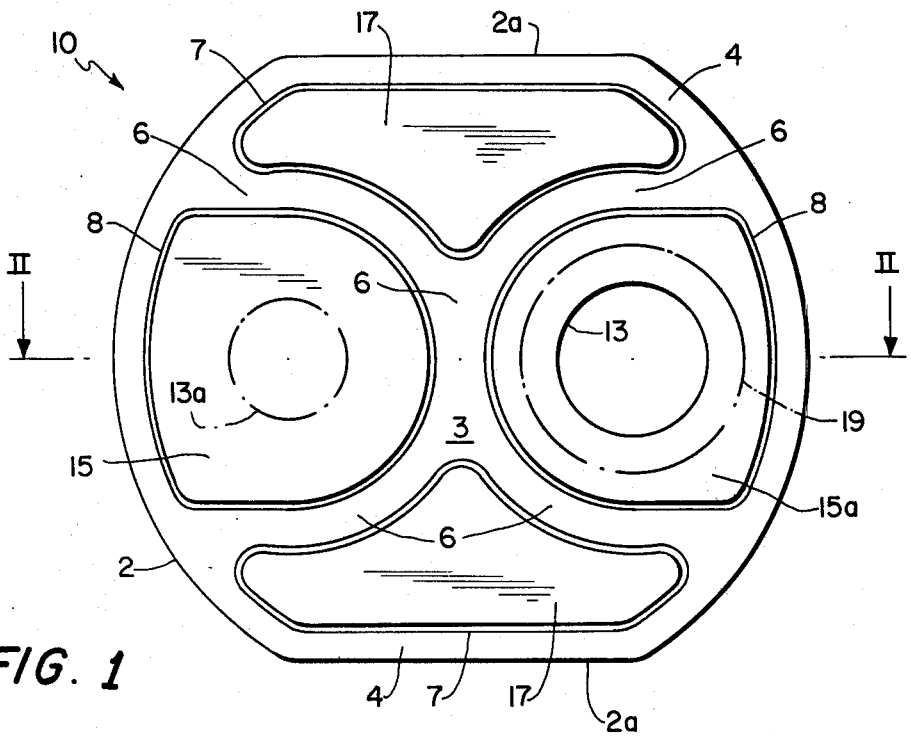
FIG. 1 is a bottom plan view of a closure element in accordance with a first embodiment of the present invention and adapted for a rotary slide closure.
Figure 2:
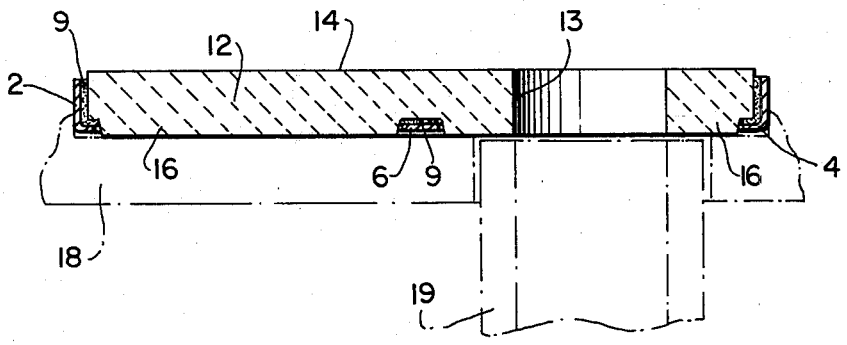
FIG. 2 is a cross section taken along line II—II of FIG. 1.

With reference now to FIGS. 1 and 2, a first embodiment of the present invention will be described. There is illustrated a closure element 10, which may be a stationary bottom plate or a sliding plate of a rotary slide closure. Such closure element or closure plate unit 10 is formed in a known manner to have a generally circular configuration with two opposite spaced straight edge portions for attachment purposes. The closure element 10 includes a refractory or fireproof plate 12 and a metallic sheath or jacket 2, 3 partially encompassing refractory plate 12 and connected thereto by means of a known type of refractory mortar layer 9. One surface 14, for example the upper surface, of refractory plate 12 is not embraced or enclosed by the metallic sheath and is precisely machined, for example by grinding, to form a sliding surface which, when the closure element is assembled, is in close sliding contact with the sliding surface of an adjacent plate of the slide closure. The refractory plate has peripheral edges and at least one flow passage 13 extending through the refractory plate from the sliding surface 14 to an opposite surface spaced therefrom. As illustrated by dashed lines, when the closure element is a sliding plate, there may conventionally be provided a further flow passage **13*a*** with the same or different diameter.

A refractory sleeve or nozzle 19 is adapted to be connected to an annular zone surrounding flow passage 13, such connection being achieved in a conventional manner.

A metal support frame is mounted in a known manner, and the closure element 10 is laterally mounted therein in a known manner, for example by means of wedges, cams or thrust bolts. This manner of connection is conventional, does not form a portion of the present invention, and is therefore not illustrated.

The metallic sheath includes an edge portion 2, **2*a* surrounding the peripheral edges of the refractory plate 12 about the entire periphery thereof and a bottom portion 3 adjacent the surface of refractory plate 12 which is opposite the sliding surface 14**. The metallic jacket may be manufactured by a deep-drawing operation from a sheet metal blank.

The bottom portion 3 of the metallic sheath has therein a plurality of perforations or openings 7, 8 which are separated from each other and from edge portion 2, 2a of the metallic sheath by a plurality of metallic strips which thus together form the bottom portion 3. Specifically, the strips include a continuous rim strip 4 which is integral with edge portion 2, 2a around the entire periphery thereof. Also, such strips include a plurality of inner strips 6 which are connected to each other and to the rim strip 4 to form a network extending and spreading over the bottom surface of the refractory plate. The openings 7, 8 expose therethrough surface areas 15, 15a, 17 of the bottom surface of the refractory plate 12. At least some of the exposed surface areas are aligned relative to the sliding surface 14 and form means for engagement with the metal support frame 18 to thereby support the closure element.

In the arrangement illustrated in FIGS. 1 and 2, the exposed surface areas 15, 15a, 17 are formed on projections 16 which extend through respective of the openings 7, 8. Projections 16 extend beyond the lower surface of the bottom portion 3 of the metallic sheath. Preferably, all of the exposed surface areas 15, 15a, 17 are aligned to extend parallel to the plane of sliding surface 14, and preferably are aligned in a single plane extending parallel to sliding surface 14. The exposed surface areas are in planar engagement with corresponding planar surfaces of the upper portion of metal support frame 18. Thus, such surfaces of support frame 18 are formed to be in planar alignment as necessary to contact the exposed surface areas and to extend parallel to sliding surface 14. In the illustrated arrangement of FIG. 2, the surfaces of support frame 18 which are in contact with the exposed surface areas 15, 17 are formed in a single plane. By providing exposed surface areas 15, 17, and possibly 15a, in a single plane, it is possible to machine such surfaces in a single operation, for example by grinding. Also, in the arrangement illustrated in FIG. 2, all of the contacting surfaces of support frame 18 may be formed by a single grinding operation forming a single planar surface on support frame 18.

According to the above-described arrangement, the metal sheath, and specifically the lower portion 3 thereof is spaced by a small distance from the support frame 18, and thus is not involved in the support and alignment of the refractory plate 12. This arrangement thereby overcomes the disadvantages of the prior art arrangements.

As illustrated, one opening 8 exposes a surface area 15a including an annular zone surrounding flow passage 13 which may have attached thereto a sleeve or nozzle 19. The annular zone may be, as illustrated in FIG. 2, provided in the same plane as the exposed surface area 15a, as well as the other exposed surface areas. Alternatively however, the annular zone may be at a different level, and provided by a recess formed within or a projection extending from the exposed surface 15a.

Figure 3:
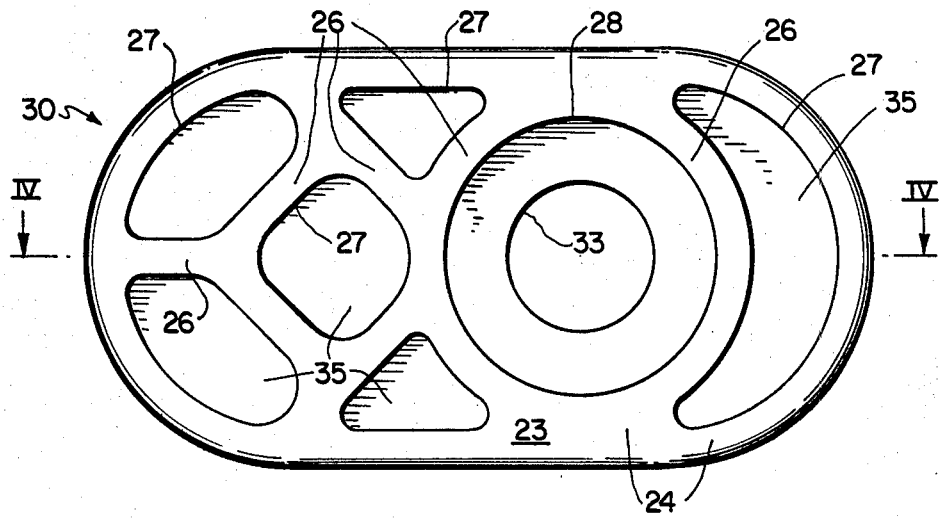
FIG. 3 is a bottom plan view of a closure element in accordance with a second embodiment of the present invention and adapted for a linearly movable slide closure.
Figure 4:
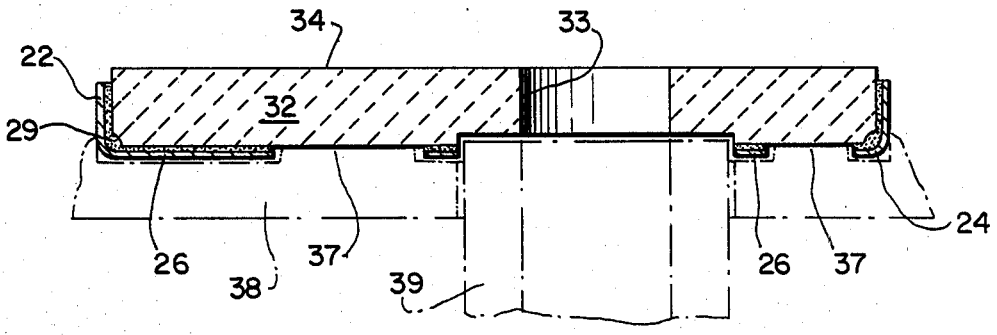
FIG. 4 is a cross section taken along line IV—IV in FIG. 3.

With reference now to FIGS. 3 and 4 of the drawings, a second embodiment of the present invention will now be described. Thus, the closure element 30 illustrated therein is specifically adapted to be a bottom plate or a sliding plate of a linearly movable slide closure. The closure element 30 includes a refractory plate 32 having a sliding surface 34, peripheral edges, and at least one flow passage 33 extending through the refractory plate from the sliding surface 34 to an opposite surface spaced therefrom. The closure element 30 also includes a metallic sheath connected to the refractory plate 32 by means of mortar 29 and including an edge portion 22 surrounding the entire periphery of the peripheral edges of the refractory plate 32, and a bottom portion 23. Bottom portion 23 is provided with openings 27, 28 separated by strips including a continuous peripheral rim strip 24 and inner strips 26. The openings 27 expose therethrough surface areas 35. However, in this embodiment, the exposed surface areas 35 are at a level inwardly of the outer surface of the bottom portion 23 of the metallic sheath. In this arrangement therefore, the metal support frame 38 has extending upwardly therefrom a plurality of projections 37 which define surfaces which are in planar engagement with the aligned exposed surfaces 35. The bottom surface of the bottom portion 23 of the metallic sheath is spaced by a small distance from corresponding facing portions of the support frame 38. In the illustrated arrangement, all of the exposed surface areas 35 are formed in a single plane by a single machining operation, such as grinding. This simplifies the construction of the refractory plate 32, although the manufacture of the support frame 38 will be somewhat more involved. It of course would be possible to have exposed areas 35 formed by appropriately planed recesses formed in the lower surface of the refractory plate 32.

One opening 28 exposes an annular zone surrounding flow passage 33. In the arrangement illustrated in FIG. 4, this annular zone is recessed with respect to the exposed surface areas 35. A refractory sleeve or nozzle 39 is attachable to the annular zone in the manner illustrated. It of course will be understood that the surface of the annular zone need not be precisely aligned, since it is not employed for the support and alignment of the refractory plate. It will be further understood that the annular zone could be at the same level as the exposed surface areas or could be formed on a projection extending outwardly from the bottom surface of the refractory plate.

It is to be understood that either of the above two described embodiments of the present invention may be modified to include any of the particular arrangements illustrated. Thus, the embodiment of FIGS. 1 and 2 could be provided with recessed exposed surface areas as in the case of the embodiment of FIGS. 3 and 4, and similarly the embodiment of FIGS. 3 and 4 could include exposed surface areas formed on projections 16 as in the case of the embodiment of FIGS. 1 and 2. Also, the manners of formation of the annular zones surrounding the flow passages may be interchangeably employed in both illustrated embodiments. Furthermore it is to be understood that instead of providing a separate refractory sleeve 19, 39, it would be possible to provide a rigid, sleevelike projection integral with the refractory plate and which is surrounded by the metal sheath. Even further, it is to be understood that the present invention encompasses the provision of exposed surface areas 15, 17, 35 which are not in a plane parallel to the respective sliding surfaces, but which are precisely aligned therewith in a different manner.

In accordance with both embodiments of the present invention, it is unnecessary to provide the bottom portion 3, 23 of the metallic sheath with a precise size or position, since in accordance with the present invention the metallic sheath plays no part in the supporting, spacing and aligning of the refractory plate. Thus, in accordance with the aspect of the invention relating to the closure element, only the sliding surface and the exposed surface areas of the refractory plate need be provided in precise predetermined alignment. In the aspect of the present invention of the closure element assembly including the frame support, it is only necessary to ensure precise alignment of the sliding surface and exposed surface areas of the refractory plate, as well as the contacting surfaces of the support frame. Thus, it is possible to assemble a closure element and a closure element assembly by practical mass production techniques without having the quality or thickness of the mortar layer affecting the relative position and spacing of the refractory plate. At the same time, the metallic sheath provides the necessary rigid envelopment and containment of the refractory plate. That is, in the event that cracks occur in the metallic plate, any resulting ceramic fragments are safely held together in position with respect to each other in spite of the very high shearing strains which will develop within the closure element during operation of the slide closure.

Although the present invention has been described and illustrated with regard to specifically preferred features thereof, it is to be understood that various modifications may be made without departing from the scope of the present invention.

What we claim is:

1. A closure element of a slide closure for use in liquid melt containers, said closure element comprising:

a refractory plate having a sliding surface, peripheral edges, and at least one flow passage extending through said refractory plate from said sliding surface to an opposite surface spaced therefrom;

a metallic sheath partially encompassing said refractory plate, said metallic sheath including an edge portion embracing said peripheral edges of said refractory plate about the entire periphery thereof and a bottom portion adjacent said opposite surface of said refractory plate;

said bottom portion of said metallic sheath having formed therein a plurality of openings exposing therethrough a plurality of surface areas of said opposite surface of said refractory plate, said openings including one said opening in the area of said flow passage, said plurality of openings being separated from each other and from said edge portion of said metallic sheath by a plurality of strips which thus form said bottom portion; and at least some of said exposed surface areas being aligned relative to said sliding surface and forming means for engagement with a metal support frame for supporting said closure element.

2. A closure element as claimed in claim 1, wherein said sliding surface is planar, and said aligned exposed surface areas are aligned to extend parallel to said sliding surface.

3. A closure element as claimed in claim 2, wherein said aligned exposed surface areas are aligned in a single plane extending parallel to the plane of said sliding surface.

4. A closure element as claimed in claim 1, wherein said strips forming said bottom portion of said metallic sheath include a continuous rim strip integral with said edge portion around the entire periphery thereof.

5. A closure element as claimed in claim 1 or 4, wherein said strips forming said bottom portion of said metallic sheath include inner strips connected to each other to form a network extending over said opposite surface of said refractory plate.

6. A closure element as claimed in claim 1, wherein said aligned exposed surface areas are formed on projections which extend through respective said openings.

7. A closure element as claimed in claim 1, wherein said aligned exposed surface areas are at a level inwardly of the outer surface of said bottom portion of said metallic sheath.

8. A closure element as claimed in claim 7, wherein said opposite surface of said refractory plate comprises a single planar surface including said aligned exposed surface areas.

9. A closure element as claimed in claim 6 or 7, wherein said aligned exposed surface areas extend in a plane at a level spaced from the outer surface of said bottom portion of said metallic sheath.

10. A closure element as claimed in claim 1, wherein said one opening exposes an annular zone of said opposite surface of said refractory plate, said annular zone surrounding said flow passage and adapted to be connected to a refractory nozzle extending said flow passage.

11. A closure element as claimed in claim 10, wherein said annular zone is at the same level as said aligned exposed surface areas.

12. A closure element as claimed in claim 10, wherein said annular zone is at a level spaced from that of said aligned exposed surface areas.

13. A closure element as claimed in claim 1, further comprising refractory mortar between said refractory plate and said metallic sheath.

14. A closure element assembly of a slide closure for use in liquid melt containers, said closure element assembly comprising:

a refractory plate having a sliding surface, peripheral edges, and at least one flow passage extending through said refractory plate from said sliding surface to an opposite surface spaced therefrom;

a metallic sheath partially encompassing said refractory plate, said metallic sheath including an edge portion embracing said peripheral edges of said refractory plate about the entire periphery thereof and a bottom portion adjacent said opposite surface of said refractory plate;

said bottom portion of said metallic sheath having formed therein a plurality of openings exposing therethrough a plurality of surface areas of said opposite surface of said refractory plate, said openings including one said opening in the area of said flow passage, said plurality of openings being separated from each other and from said edge portion of said metallic sheath by a plurality of strips which thus form said bottom portion;

at least some of said exposed surface areas being aligned relative to said sliding surface; and a metal support frame having surfaces in planar engagement with said aligned exposed surface areas, thereby supporting said refractory plate and said metallic sheath.

15. A closure element assembly as claimed in claim 14, wherein said bottom portion of said metallic sheath is spaced from and out of contact with said metal support frame.

16. A closure element assembly as claimed in claim 14, wherein said sliding surface is planar, and said aligned exposed surface areas are aligned to extend parallel to said sliding surface.

17. A closure element assembly as claimed in claim 16, wherein said aligned exposed surface areas are aligned in a single plane extending parallel to the plane of said sliding surface.

18. A closure element assembly as claimed in claim 14, wherein said strips forming said bottom portion of said metallic sheath include a continuous rim strip integral with said edge portion around the entire periphery thereof.

19. A closure element assembly as claimed in claim 14 or 18, wherein said strips forming said bottom portion of said metallic sheath include inner strips connected to each other to form a network extending over said opposite surface of said refractory plate.

20. A closure element assembly as claimed in claim 14, wherein said aligned exposed surface areas are formed on projections which extend through respective said openings.

21. A closure element assembly as claimed in claim 20, wherein said surfaces of said metal support frame are in a single plane.

22. A closure element assembly as claimed in claim 14, wherein said aligned exposed surface areas are at a level inwardly of the outer surface of said bottom portion of said metallic sheath.

23. A closure element assembly as claimed in claim 22, wherein said surfaces of said metal support frame are on projections extending through respective said openings.

24. A closure element assembly as claimed in claim 22, wherein said opposite surface of said refractory plate comprises a single planar surface including said aligned exposed surface areas.

25. A closure element assembly as claimed in claim 20 or 22, wherein said aligned exposed surface areas extend in a plane at a level spaced from the outer surface of said bottom portion of said metallic sheath.

26. A closure element assembly as claimed in claim 14, wherein said one opening exposes an annular zone of said opposite surface of said refractory plate, said annular zone surrounding said flow passage and adapted to be connected to a refractory nozzle extending said flow passage.

27. A closure element assembly as claimed in claim 26, wherein said annular zone is at the same level as said aligned exposed surface areas.

28. A closure element assembly as claimed in claim 26, wherein said annular zone is at a level spaced from that of said aligned exposed surface areas.

29. A closure element assembly as claimed in claim 14, further comprising refractory mortar between said refractory plate and said metallic sheath.

* * * * *